US008963787B2

(12) United States Patent
Lee-Bouhours et al.

(10) Patent No.: US 8,963,787 B2
(45) Date of Patent: Feb. 24, 2015

(54) ANTENNA LENS COMPRISING A DIELECTRIC COMPONENT DIFFRACTIVE SUITABLE SHAPING A WAVEFRONT MICROWAVE

(71) Applicant: Thales, Neuilly sur Seine (FR)

(72) Inventors: Mane-Si Laure Lee-Bouhours, Palaiseau Cedex (FR); Brigitte Loiseaux, Palaiseau Cedex (FR); Jean-Francois Allaeys, Palaiseau Cedex (FR); Romain Czarny, Palaiseau Cedex (FR); Jean-Pierre Ganne, Palaiseau Cedex (FR)

(73) Assignee: Thales, Neuilly sur Seine (FR)

( * ) Notice: Subject to any disclaimer, the term of this patent is extended or adjusted under 35 U.S.C. 154(b) by 205 days.

(21) Appl. No.: 13/627,780

(22) Filed: Sep. 26, 2012

(65) Prior Publication Data

US 2013/0076581 A1 Mar. 28, 2013

(30) Foreign Application Priority Data

Sep. 26, 2011 (FR) ..... 11 02910

(51) Int. Cl.
*H01Q 19/06* (2006.01)
*H01Q 15/08* (2006.01)

(52) U.S. Cl.
CPC ..... *H01Q 15/08* (2013.01)
USPC ..... 343/753; 343/911 R

(58) Field of Classification Search
CPC ..... H01Q 15/02; H01Q 15/08; H01Q 19/06
USPC ..... 343/911 R, 753
See application file for complete search history.

(56) References Cited

U.S. PATENT DOCUMENTS 6,081,239 A * 6/2000 Sabet et al. ..... 343/753
2010/0066639 A1 3/2010 Ngyuen et al.

FOREIGN PATENT DOCUMENTS

WO 0025387 A1 5/2000

OTHER PUBLICATIONS

French Search Report dated Jul. 25, 2012 issued in the corresponding French Patent Application No. 1102910.

(Continued)

*Primary Examiner* — Hoang V Nguyen
(74) *Attorney, Agent, or Firm* — Buchanan Ingersoll & Rooney PC

(57) ABSTRACT

A lens antenna including at least one diffractive dielectric component capable of shaping a microwave frequency wave front having a wavelength comprised in a range from 1 millimeter to 50 centimeters, said diffractive dielectric component including a plurality of main microstructures formed in a substrate material with a substrate refractive index so as to form an artificial material of an effective refractive index, each main microstructure having a size of less than a target wavelength taken from said range of wavelengths, said main microstructures being laid out per zones, so as to make a surface filling level vary, the effective refractive index being a function of said surface filling level, the layout being such that the effective refractive index varies inside said one zone of said diffractive dielectric component quasi monotonously between a minimum value and a maximum value less than or equal to the substrate refractive index.

13 Claims, 8 Drawing Sheets

(56) References Cited

OTHER PUBLICATIONS

Kenichi Sato et al., "A Plate Luneberg Lens with the Permittivity Distribution Controlled by Hole Density", Electronics and Communications in Japan, Wiley Periodicals, Inc., Hoboken, NJ, US, Part 1, vol. 85, No. 9, Jan. 1, 2002, pp. 1-12, XP001123461, ISSN:8756-621, DOI:10.1002/ECJA.1120.

T. Morita et al., "Microwave Lens Matching by Simulated Quarter-Wave Transformers", IRE Transactions on Antennas and Propagation, IEEE inc., New York, NY, US, vol. AP-4, No. 1, Jan. 1, 1956, pp. 33-39, XP002201816.

* cited by examiner

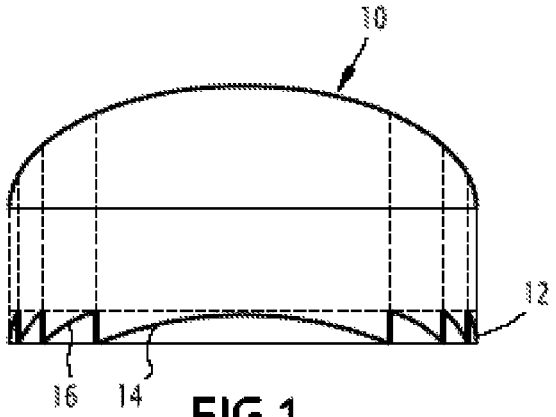
FIG.1
FIG.2
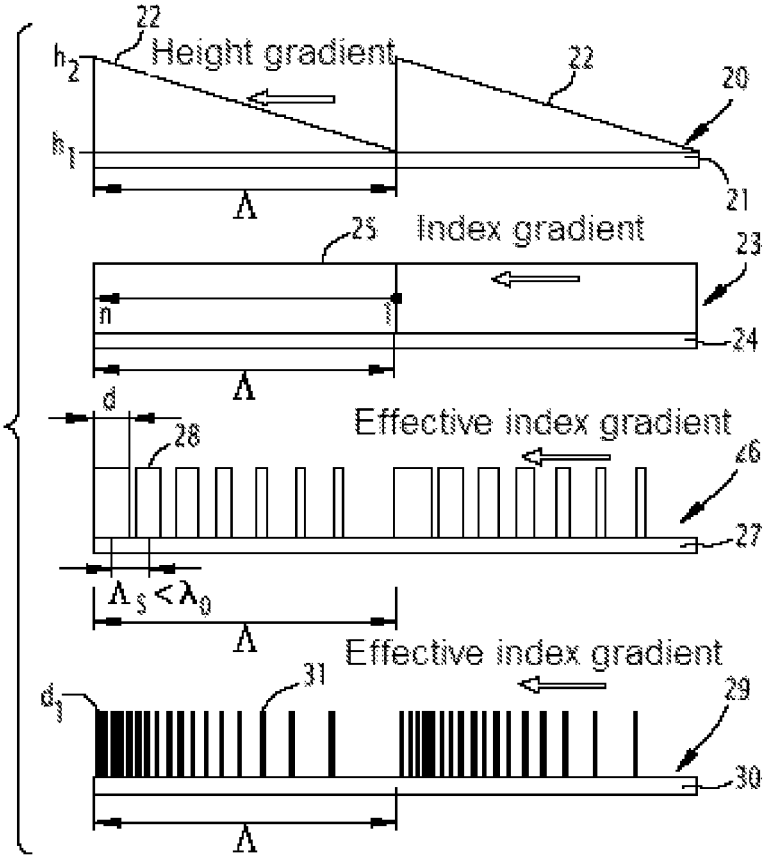

ANTENNA LENS COMPRISING A DIELECTRIC COMPONENT DIFFRACTIVE SUITABLE SHAPING A WAVEFRONT MICROWAVE

The present invention relates to a lens antenna comprising a diffractive dielectric component capable of shaping a microwave frequency wavefront.

The invention finds particular application in the field of Hertzian telecommunications, extending in a known way from about 400 MHz to 300 GHz and corresponding to waves of respective centimetric and millimetric wavelengths.

In this field, it is common to have antennas which are large as compared with the wavelength in order to produce high power and highly directive emissions and obtain a large antenna gain.

One of the problems posed by this type of antenna is its bulkiness and its weight. Indeed, in many applications, both for esthetical reasons and for reasons of costs, it is preferable to have antennas with low bulkiness.

A family of antennas with which this need for reducing bulkiness may be met, is the family of lens antennas, in which a radiofrequency source is placed at the focal point of a dielectric lens.

In order to make such antenna compact, a known solution is to reduce the focal length/diameter ratio (F/D) of the lens, by thereby having optics with a large numerical aperture. Typically the F/D ratio is less than 0.5 for the frequency band from 30 GHz to 50 GHz known as the Q band, respectively corresponding to a wavelength range from 6 mm (corresponding to 50 GHz) to 10 mm (corresponding to 30 GHz).

It is possible to use thick refractive lenses, but in this case the low F/D ratio induces very great curvature on the edges, which makes their manufacturing complex in order to maintain a good yield. Further, these lenses are thick, therefore their bulkiness and their weight are not satisfactory.

Alternatively, the use of diffractive lenses, also known as Fresnel lenses, is known, for which the thickness is small and remains constant even when the F/D ratio decreases. As illustrated in FIG. 1, in order to obtain the same focusing as with a thick refractive lens 10, a Fresnel lens 12 comprises several concentric annular areas 14, 16, also called Fresnel zones, positioned in a same plane. The known drawbacks of Fresnel lenses are lower diffraction efficiency and losses due to a shadowing effect due to the cutting out into zones. It was shown that the shadowing effect was particularly significant for large numerical apertures corresponding to low F/D values. Indeed, on the one hand, during the manufacturing of such a Fresnel lens, it is delicate to simultaneously control continuously variable zones and discontinuities with a sudden transition (corresponding to the zone edge vertical walls). The result of this is that the manufactured lenses have a rounded shape at the discontinuities. This rounded shape causes a significant drop in the diffraction efficiency, notably when the size of a Fresnel zone is not large as compared with the wavelength. Generally, the more an optical system is open (f/d), the smaller is the size of Fresnel zones.

On the other hand, even for an ideal lens without any roundness at the discontinuities, a shadowing zone is observed for each discontinuity, in which the incident rays are deflected by the edge of the adjacent Fresnel zone and do not participate in diffraction.

An application of Fresnel lenses for use in the microwave frequency domain was proposed by A. Petosa, and S. Thirakoune in the article 'Investigation on arrays of perforated dielectric Fresnel lenses', published in IEEE Proc. on Microwave Antenna Propagation, Vol. 153, No. 3, June 2006. The manufacturing of Fresnel lenses by perforating holes with variable diameters in an initially homogeneous dielectric material is described therein in order to obtain four permittivity levels, the permittivity being equal to the square of the effective refractive index.

In this solution, the lens is formed with four concentric zones each pierced with holes of constant diameter, spaced apart by dielectric material zones without any holes, thereby forming four separate Fresnel zones. The holes are of a small diameter as compared with a target wavelength, corresponding to a frequency of 30 GHz. A dielectric material with a large refractive index n=2.4 was used for facilitating the making of the holes. The experimental results have shown that the reckoned increase was not reached by this perforated dielectric lens, notably because of losses by reflections passing from 4% per interface to a value located between 0% and 17% (with the material of index n=2.4), since the synthesized effective index assumes four values comprised between 1 and 2.4. In fact, this solution provided a smaller gain than a conventional Fresnel lens with four refractive index levels, made in a material with a lower index, such as Plexiglas with an index of n=1.61, as mentioned in A. Petosa, A. Ittipiboon, <<Design and performance of a perforated dielectric Fresnel lens>>, IEEE Proceedings of Microwave Antenna Propagation, 2003, 150, (5), pp. 309-314. The solution proposed by Petosa et al. therefore shows unsatisfactory performances.

Therefore, it is desirable to find a remedy to the drawbacks of the state of the art and to propose a solution with which a good yield may be obtained while having low reflection losses and low bulkiness in the microwave frequency domain.

For this purpose, according to a first aspect, the invention proposes a lens antenna including at least one diffractive dielectric component capable of shaping a microwave frequency wavefront having a wavelength comprised in a range from 1 millimeter to 50 centimeters, characterized in that said diffractive dielectric component includes a plurality of main microstructures formed in a substrate material with a substrate refractive index so as to form an artificial material with an effective refractive index, each main microstructure having a size of less than one target wavelength taken from said range of wavelengths, said main microstructures being laid out by zones, so as to make a surface filling level vary, the effective refractive index depending on said surface filling level, the layout being such that the effective refractive index varies inside of said one zone of said diffractive dielectric component quasi monotonously between a minimum value and a maximum value less than or equal to the substrate refractive index.

Advantageously, a lens antenna according to the invention has a good yield and has low bulkiness. Indeed, a diffractive dielectric component with a layout of main microstructures with a size of less than the target wavelength, called sub-wavelength microstructures, allows the synthesis, for a zone of the component, of a quasi continuous, quasi monotonous change in the effective refractive index with a large number of patterns of sub-wavelength microstructures. With this, it is possible to improve the diffraction efficiency and to avoid losses by a shadowing effect. Further, the solution proposed by the invention allows maximization of the guiding effect and therefore maximization of the efficiency of the dielectric component, by which it is possible to obtain lens antennas which are efficient in the microwave frequency domain.

The lens antenna according to the invention may also have one or more of the features below:

- the density of main microstructures per unit surface varies in a zone of said dielectric component, the size of each main microstructure being set;

the size of said main microstructures is variable for a zone of said dielectric component;

said main microstructures have a square or circular section, a width equal to K times the target wavelength taken from said range of wavelengths, K being comprised between 1/50 and 1/1.5;

said main microstructures are pillars formed as protrusions on said substrate material and/or holes formed in said substrate material;

as said main microstructures are pillars formed as protrusions on said substrate material, the diffractive dielectric component further includes, in addition to said main microstructures, at least one layer including secondary microstructures with a size less than the size of said main microstructures, said secondary microstructures being suitable for decreasing the reflections of an incident microwave frequency wave;

said diffractive dielectric component includes several layers of stacked secondary microstructures, each layer of secondary microstructures comprising pillars formed as protrusions on said main or secondary microstructures of the layer preceding said layer of secondary microstructures;

said main microstructures are positioned on a first face of said diffractive dielectric component, characterized in that said diffractive dielectric component includes a layer of secondary microstructures positioned on a second face of said diffractive dielectric component, opposite to said first face;

said main microstructures and/or said secondary microstructures have a conical shape;

as said main microstructures are positioned on a first face of said diffractive dielectric component, the diffractive dielectric component includes a non-diffractive layer of sub-wavelength microstructures, producing an associated phase function, on a second face of said diffractive dielectric component opposite to said first face;

said diffractive dielectric component further includes a neutral dielectric plate for thickness protection, depending on said target wavelength; and said diffractive dielectric component is a rectangular array of said diffractive dielectric components with a square or rectangular section.

Other features and advantages of the invention will become apparent from the description which is given thereof below, as an indication and by no means as a limitation, with reference to the appended drawings, wherein:

FIG. 1 already described, is a sectional view matching conventional lenses, i.e. a refractive lens and a Fresnel diffractive lens with a blazed profile;

FIG. 2 is a sectional view of various embodiments of a diffractive dielectric component of the blazed grating type;

Figure 3:
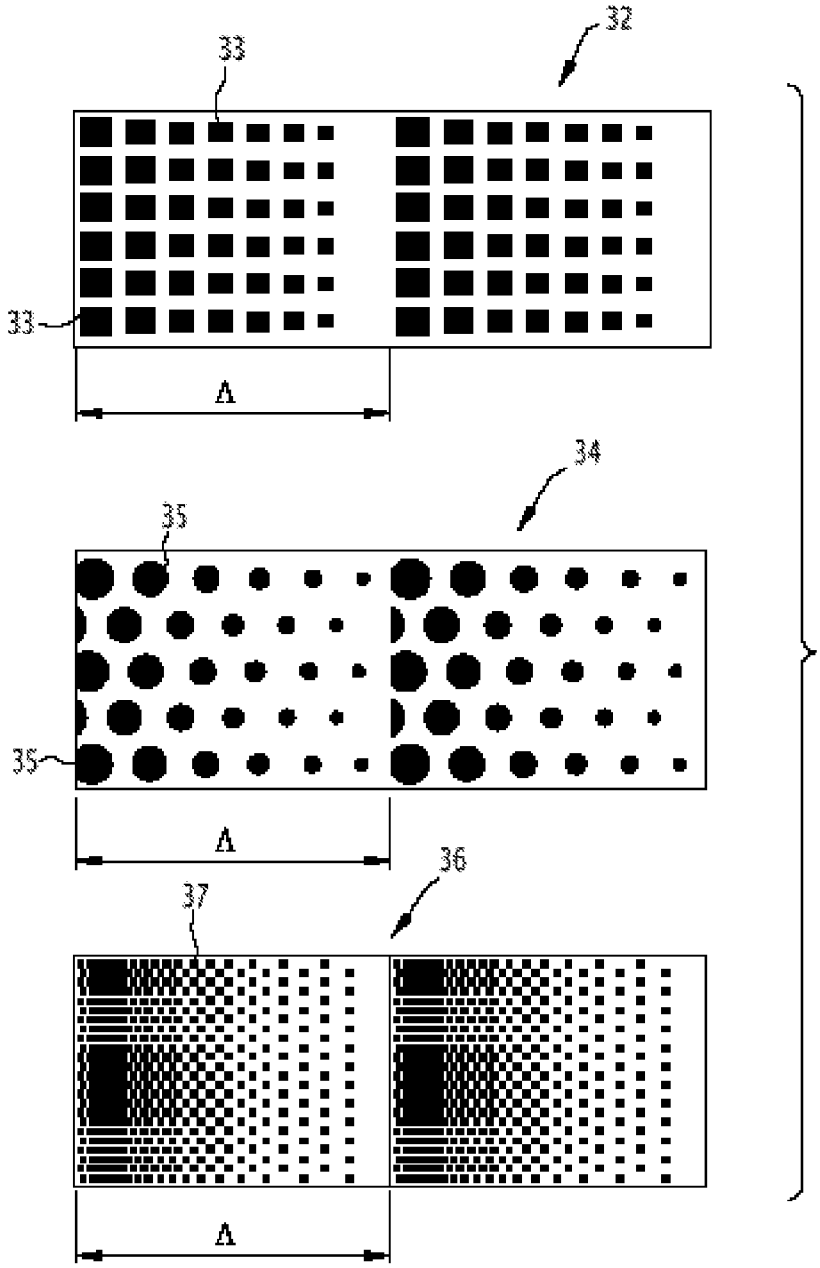
FIG. 3 is a top view of various embodiments of a diffractive component of the blazed grating type according to the invention.

The invention will be described more particularly in the application of diffractive dielectric lenses or diffractive dielectric components for a lens antenna in the microwave frequency field in a range from 30 GHz to 50 GHz (known as the Q band) which is a particular range of the microwave frequency domain. Such a lens antenna consists of a source of microwave frequency electromagnetic waves and of a lens, which is a diffractive dielectric component and which collects and reshapes the wave generated by the source, which results in a modified wavefront. The source is located at the focal point of this component, or more generally in proximity to the focal point of this component.

In order to illustrate the making of an artificial material with a monotonous change in efficient index or a quasi index gradient, various embodiments of a blazed grating operating in transmission are described with reference to FIG. 2.

The component 20 of FIG. 2 is a diffractive component, a so-called blaze grating, made in a substrate material 21 and consisting of two echelons (step-like structures) 22 of period $\lambda$ each echelon corresponding to a zone of the component. It is a conventional diffractive dielectric component, made in a substrate material with a given substrate refractive index, in which the monotonous change in refractive index is obtained by varying the height between the height h1 and the height h2 of each echelon 22.

Subsequently, the refractive index will be simply called an index.

A blazed grating gives the possibility of producing a phase or phase shift function $\Delta\Phi(\lambda_0, x, y)$, $\Delta\Phi$ being the phase lag introduced by the dielectric component at the coordinates (x,y) of the component, which depends on the index n and on the height of the component:

$$\Delta\Phi(\lambda_0, x, y) = \frac{2\pi}{\lambda_0}(n(x, y) - n_0)h(x, y), \quad \text{(Eq1)}$$

Wherein $\lambda_0$, is the target wavelength in the relevant domain and $n_0$ is the lowest reached index, and h(x,y) is the function giving the height of the component at a point in space of coordinates (x,y) in a spatial reference system. On a blazed grating in air, the phase function is obtained by the change in the height, while keeping n(x,y)=n, the refractive index of the material. The phase or phase shift function becomes:

$$\Delta\Phi(\lambda_0, x, y) = \frac{2\pi}{\lambda_0}(n-1)h(x, y).$$

The maximum height $h=(h_2-h_1)$ is calculated depending on the index variation $n-n_0$, in order to obtain a phase shift of $2\pi$.

$$h(x, y) = \frac{\lambda_0}{(n-1)},$$

for a blazed grating etched in Rexolite (n=1.59) surrounded by air ($n_0$=1). As an indication, the height of a grating in glass is equal to 12.3 mm at $\lambda_0$=7.14 mm.

The component 23 of FIG. 2 is made in a substrate material 24 and comprises two zones or echelons 25 with constant height, corresponding to the echelons 22 of the component 20 with increasing monotonous index variation per zone, or an index gradient, between the minimum value 1 which is the index of the vacuum, and n, n being greater than 1, the variation being schematically illustrated by an arrow. The phase shift in this case becomes:

$$\Delta\Phi(\lambda_0, x, y) = \frac{2\pi}{\lambda_0}(n(x, y)-n_0)h.$$

In practice, such an index gradient with constant height at this scale is very difficult to obtain in the field of radio/microwave frequencies. This requires the use of complex techniques for combining and incorporating materials (for example glass fabric and PTFE Teflon).

An alternative for obtaining a monotonous variation of the index or an index gradient according to the invention is illustrated by the component 26 of FIG. 2. The component 26 is formed by a substrate 27 comprising sub-wavelength microstructures 28, which are pillars in this example. The sub-wavelength microstructures may be holes or pillars, these microstructures having the effect of locally varying the amount of dielectric material. The microstructures of the component 26 are laid out in zones, which are zones of period $\Lambda$ in the case of a grating, or Fresnel zones in the case of a lens, or any zones in the case of a non-periodic component. Inside a zone, the effective refractive index varies quasi monotonously, between a minimum value and a maximum value of less than or equal to the refractive index of the substrate 27.

Advantageously, the diffraction efficiency is improved since, by using sub-wavelength microstructures, the shadowing effect obtained with the blazed embodiment 20 is avoided and it is therefore possible to increase the yield of the dielectric component 26 relatively to the yield of the blazed component 20. The pillars 28 which have a square, circular or hexagonal section for example, have variable widths, the maximum width being equal to d which is less than $\lambda_0$, the target wavelength in the relevant microwave frequency domain. The pillars are laid out in a periodic structure with period $\Lambda_s$ which is the distance between the centers of two consecutive pillars in the example of FIG. 2. Alternatively, the layout structure is pseudo-periodic with distances close to $\Lambda_s$ typically comprised about 0.75 $\Lambda_s$, and 1.25 $\Lambda_s$ for inducing a little disorder which would in certain cases allow smoothing or reducing of undesired orders of diffraction. The microstructures are laid out per zones according to a meshing which is square, rectangular or hexagonal for example.

When the period $\Lambda_s$ is less than the wavelength $\lambda_0$, the dielectric component behaves like an artificial material for which the effective index locally varies per zone monotonously, forming a material with a quasi effective index gradient. This layout of the microstructures gives the possibility of synthesizing a large number of different effective indices N, with N>4, typically N=8, the N effective indexes gradually varying in small steps.

Preferably, $$\Lambda_s \leq \frac{\lambda_0}{\max(n_s, n_{inc}) + n_{inc} \times \sin(\theta)}, \quad \text{(Eq2)}$$

wherein $n_s$ is the refractive index of the substrate dielectric material, $n_{inc}$ is the refractive index of the incident medium (generally the incident medium is air, $n_{inc}$=1), and $\theta$ is the angle of incidence of the beam of waves on the dielectric component. If the period $\Lambda_s$ is selected to be greater than the value given by formula Eq2, the dielectric component no longer has the desired property of an artificial material with a quasi index gradient.

In the case of a diffractive lens or a grating, the height h of the component is calculated in order to obtain a phase shift multiple of $2\pi$, generally simply $2\pi$, which induces:

$$h = \frac{\lambda_0}{(n_{max} - n_{min})},$$

wherein $n_{max}$ and $n_{min}$ are the effective maximum and minimum indices, the effective maximum index being less than or equal to the index of the substrate.

The effective index depends on the geometry of the sub-wavelength microstructure.

For microstructures in the form of pillars, a surface filling level is defined which is equal to the surface occupied by the pillars contained in a unit surface divided by this same unit surface. A unit surface is defined as the surface of the square of side $\Lambda_s$. The effective index is almost proportional to the surface filling level.

For hole-shaped microstructures, the surface filling level is equal to the remaining substrate dielectric material surface per unit surface divided by this same unit surface.

Generally, the surface filling level represents the substrate material surface making up the artificial material per unit surface.

The component 29 of FIG. 2 illustrates an alternative embodiment of an index variation in a substrate dielectric material 30 according to the invention, with which an effective index variation may be obtained, similar to the one obtained with the component 26; a set of pillars 31 with a given width $d_1$, which is less by an order of magnitude than that of the target wavelength $\lambda_0$, $d_1 \ll \lambda_0$ which are laid out according to variable density per unit surface. In practice, $d_1 < \Lambda_s/2$, will be selected, typically with $d_1 = \Lambda_s/5$. The variation of the density also allows variation of the surface filling level, and therefore of the effective index of the component 29.

It may also be envisioned to combine microstructures of variable size and their variable density layout in a same diffractive dielectric component.

Alternatively, a dielectric component with an index gradient is built on the basis of microstructures of the hole type on the same principle, by piercing in the dielectric material holes with set diameter or size and by varying the number of holes per unit surface.

FIG. 3 illustrates a top view of various embodiments of diffractive dielectric components with blazed gratings according to the invention.

A first top view 32 illustrates a first embodiment of a diffractive dielectric component 26, with two zones or echelons, comprising microstructures 33 with a square section of variable size, and laid out according to square meshing.

A second top view 34 illustrates a second embodiment of a diffractive dielectric component 26, with two zones or echelons, comprising microstructures 35 with a circular section and of variable diameter, laid out according to hexagonal meshing.

Finally, the view 36 illustrates an embodiment of a diffractive dielectric component 29 with two zones or echelons, comprising microstructures 37 with a square section of constant size, laid out with variable surface density.

All the types of microstructures—holes or pillars, with a round, square section or according to another geometrical shape—are suitable for producing diffractive dielectric components for microwave frequency waves with a microwave wavelength, since the dimensions of the microstructures, calculated from the target wavelength are greater than 1 mm and therefore do not require very expensive manufacturing technology.

In the preferred embodiment of the invention, the diffractive dielectric component is made with microstructures of the pillar type, which have the advantage of optimizing the guiding of waves and therefore increasing diffraction efficiency.

In an embodiment, holes and pillars are associated in a same component.

In a non-restrictive way, these microstructures according to an embodiment, are microstructures with a square, round, oval, hexagonal section with an equal width over the depth, i.e. on a straight or almost straight flank in the thickness of the component.

According to an alternative embodiment, the microstructures are cone-shaped, i.e. having flanks which are not straight in the thickness of the substrate, for example with a smaller diameter on the air side and a larger diameter on the substrate side.

Figure 4:
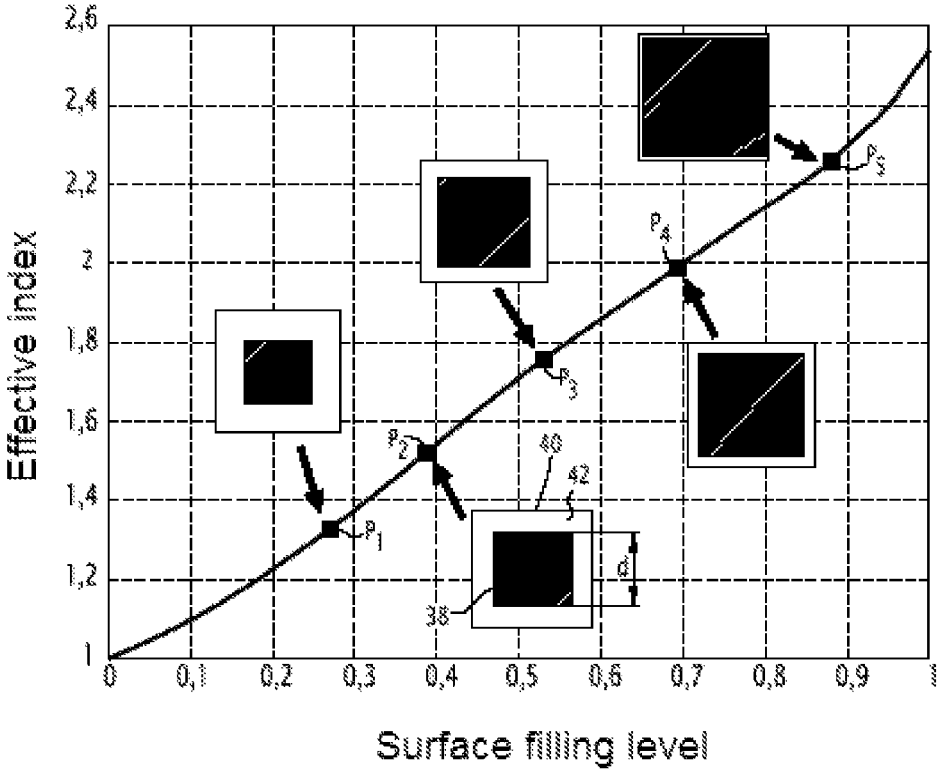
FIG. 4 is a graph illustrating the effective index of the diffractive dielectric component consisting of periodic pillars versus the surface filling level, on a substrate of index 2.54.
Figure 5:
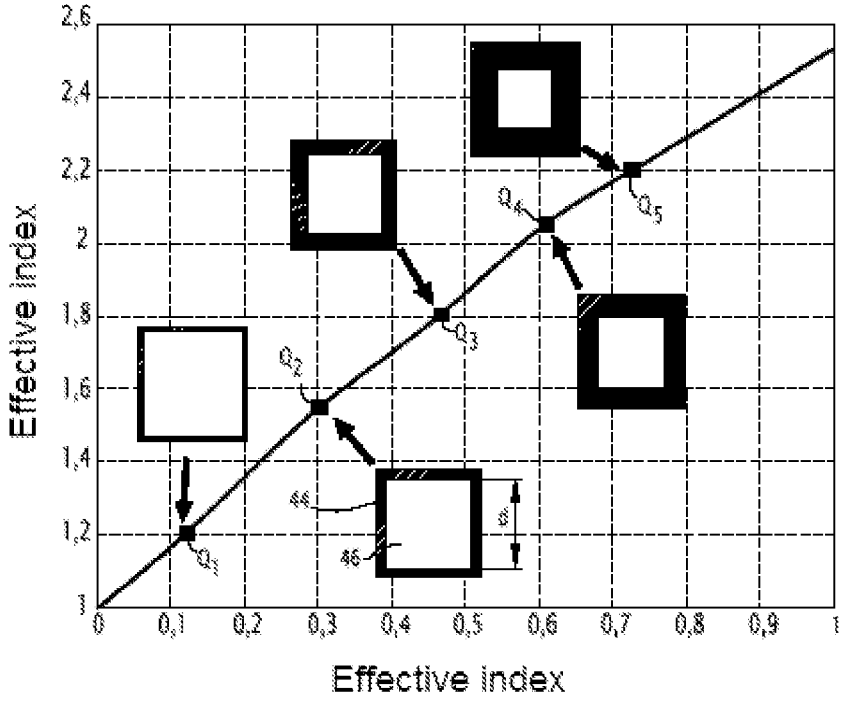
FIG. 5 is a graph illustrating the effective index of the diffractive dielectric component consisting of periodic holes versus the surface filling level, on a substrate of index 2.54.
Figure 6:
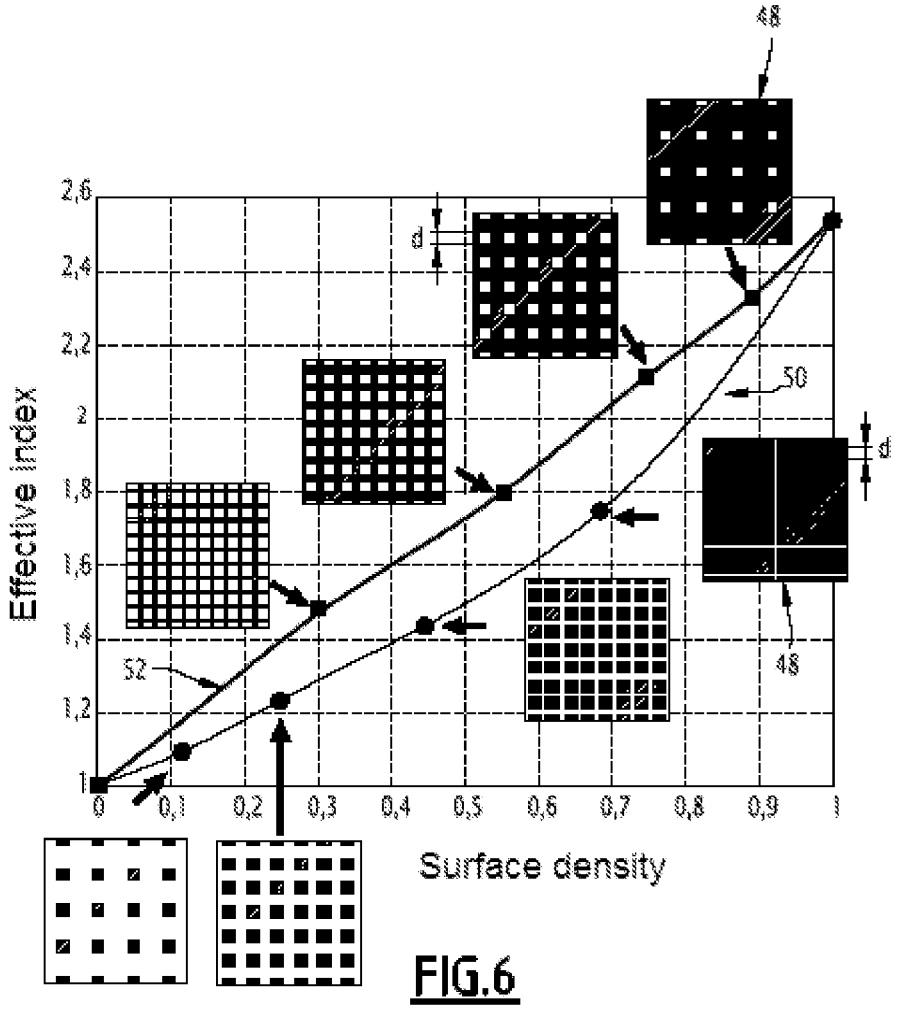
FIG. 6 is a graph illustrating the respective effective indices of the diffractive dielectric component consisting of periodic pillars or holes with a set size versus the surface filling level, on a substrate of index 2.54.

FIGS. 4 to 6 provide several examples for dimensioning the microstructure in order to obtain various effective indices.

FIG. 4 is a graph illustrating the effective index of the dielectric component consisting of periodic pillar microstructures versus the surface filling level.

In abscissas, is illustrated the surface filling level, which varies between 0 and 1, and in ordinates, the effective index of the obtained artificial material, which varies between 1 and 2.6.

The graph corresponds to pillars with a period of $\Lambda_s$=2.4 mm, made in a substrate dielectric material with a substrate index $n_s$=2.54. The target wavelength $\lambda_0$ is 7.14 mm, corresponding to a frequency of about 42 GHz. The period $\Lambda_s$ is in this example equal to $0.336\times\lambda_0$. This choice corresponds to an aperture of f/1.4. For an aperture of f/0.25, the value of $\Lambda_s$ is calculated by using the formula Eq2 with $\theta$=63°, which is the angle of incidence corresponding to the f/0.25 aperture.

As illustrated in FIG. 4, the effective index is almost proportional to the surface filling level. In particular five points of the graph noted as $P_1$ to $P_5$ have been distinguished.

With regard to each of the points $P_1$ to $P_5$, the surface filling level of the pillars is schematically illustrated by a top view of each centered pillar with a square section 38 per unit surface 40. The zone 38 represents the dielectric material making up the pillar, the zone 42 corresponds to air (a zone left empty around the pillars).

The side d of the square section of each pillar varies between a value of d=1.28 mm, which corresponds to $0.179\times\lambda_0$ for the point $P_1$ at d=2.3 mm, which corresponds to $0.322\times\lambda_0$ for the point $P_5$. If the use of pillars with a width varying between 0 and the size of $P_4$ is assumed, the obtained index deviation is equal to ~1, leading to a height of the component of about h=7.1 mm.

The graph of FIG. 5 is similar to that of FIG. 4 for a dielectric component consisting of periodic holes.

Similarly to the graph of FIG. 4, in abscissas, is illustrated the surface filling level, which varies between 0 and 1 and in ordinates, the effective index of the obtained material, which varies between 1 and 2.6.

The graph of FIG. 5 corresponds to holes with a period of $\Lambda_s$=2.4 mm, made in a dielectric material with an initial index of $n_s$=2.54, for a target wavelength $\lambda_0$=7.14 mm, corresponding to a frequency of about 42 GHz.

The surface filling level is given here by the surface occupied by the dielectric material, i.e. the surface area 44 minus the hole zone 46 area of square section with a side d. Naturally, the side d is inversely proportional to the surface filling level in this case.

As illustrated in FIG. 5, the obtained effective index is almost proportional to the surface filling level. With regard to each of the points $Q_1$ to $Q_5$, the surface filling level is schematically illustrated by a top view of the holes 46 per unit surface 44. If the use of holes with a size varying between 0 and that of Q2 is assumed, the obtained index deviation is equal to ~1, leading to a height of the component of about 7.2 mm.

FIG. 6 is a graph illustrating the effective index of the dielectric component consisting of periodic pillars and holes with constant size and with a variable density per unit surface, versus the surface filling level.

As in the previous figures, in abscissas, is illustrated the surface filling level which varies between 0 and 1, and in ordinates, the effective index of the obtained material, which varies between 1 and 2.6.

In this embodiment, the conditions were retained: refractive index of the substrate dielectric material $n_s$=2.54 and target wavelength $\lambda_0$=7.14 mm.

The size d of the side of the square section of each of the microstructures (hole or pillar) is constant and equal to 0.2 mm, and it is the density of material per unit surface which varies. For this embodiment, the advantage of facilitating manufacturing also subsists, the manufacturing of the microstructures being easy because of their constant size. The macroscopic period of an elementary cell is $\Lambda_s$=2.4 mm, therefore each square unit surface 48 area corresponds to 2.4 $mm^2$.

The curve 50 corresponds to microstructures with a pillar shape, and curve 52 corresponds to microstructures with a hole shape.

In the squares 48, the hatched zones correspond to the dielectric material and the zones without any filling correspond to air.

In an alternative, both geometries i.e. pillars and holes, are combined in order to be able to use the whole of the index deviation and to decrease the height of the structures. For example by using a combination of holes and pillars, for which the sizes vary between 0 and that of $P_4$ for the pillars and between 0 and that of Q2 for the holes, the index deviation becomes equal to 1.54, leading to a height of about 4.6 mm.

Thus, the pillar and hole combination gives the possibility of further reducing the bulkiness of the diffractive dielectric component.

In another alternative, in order to facilitate the manufacturing method, the dielectric component consists of pillars of constant size, and laid out so as to vary their density in order to obtain a quasi index gradient, with a variable number of pillars per unit surface. In the microwave frequency domain of application, the target wavelengths are typically located in a range from 1 mm to 75 cm, and the size of the typical side of the pillar microstructures is $d=K\times\lambda_0$, with K comprised between 1/50 and 1/1.5. Many microstructures may be easily made by molding and therefore produced in large numbers.

Alternatively, the pillar microstructures laid out as zones positioned on both opposite faces of the dielectric component, so as to associate two phase functions, one on each side of the component. Advantageously, the height of the microstructures is then distributed on both opposite faces, involving microstructures which are easier to make. Further, the second face has an effective index which varies between 1 and the index of the substrate, therefore a lower effective index on average, which allows reduction of the losses on the second interface.

According to another alternative, the diffractive dielectric component includes, on a first face, a so-called diffractive face of the microstructures, for example of the pillar type, laid out in zones and on the opposite face which is the first face encountered by the wavefront resulting from the source and which is a non-diffractive face in this case, structuration with sub-wavelength microstructures producing a sub-wavelength phase function allowing shaping of the wavefront from the source. Thus, the treatment applied on the face encountered first by the wavefront allows the wavefront to be corrected, notably for making it perfectly spherical before reaching the diffractive face. On the non-diffractive face, the sub-wavelength microstructures are for example pillars of variable sizes or of a fixed size and with variable density, producing a slow change in effective index. The microstructures of the first face are not laid out in several zones with an effective index change like for the diffractive face.

In a particularly advantageous embodiment, the dielectric component formed with pillar microstructures also comprises impedance matching, so as to reduce the losses due to reflections of an incident wave at the interfaces between the air and the artificial dielectric material. Indeed, in a known way, for a dielectric material of index n=2.4, the loss by reflection (or by mismatching) at each interface with the air of index n=1 is equal to 17%.

Reduction of these losses is known as an anti-reflective treatment in optics and impedance matching in the field of microwave frequencies.

FIGS. 7 to 10 illustrate various profiles of the dielectric component with impedance matching.

Figure 7:
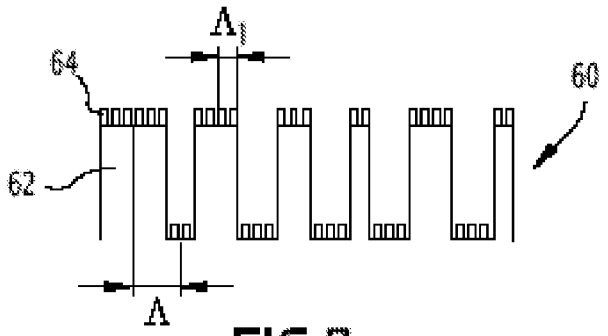
FIG. 7 is a sectional view of a diffractive dielectric component according to a first embodiment with impedance matching.

In a first embodiment illustrated in FIG. 7, the dielectric component 60 comprises on one face, which is the diffractive face, main microstructures laid out in zones, with the shape of pillars 62, with variable sizes in order to obtain an index gradient as explained above. On these pillars and between these pillars, protruding micro-pillars 64 are integrated, which are secondary sub-wavelength microstructures of period $\Lambda_1$ of an order of magnitude of less than the period $\Lambda_s$ of the pillars 62, typically $\Lambda_s/10\leq\Lambda_1\leq\Lambda_s/2$ and with a size $d_2$ less than the width of the pillar of smaller section. Practically, an example of an order of magnitude of $d_2$ is $d_2=d/3$. The secondary microstructures are periodic and are not laid out in several zones, like the main microstructures.

The period $\Lambda_1$ and the size $d_2$ are selected by simulation so as to locally reduce the index of the dielectric component at the interface with air.

Figure 8:
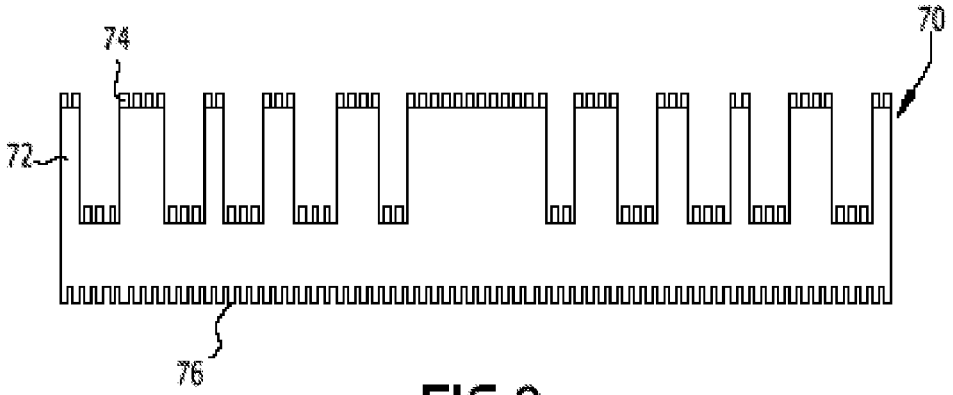
FIG. 8 is a sectional view of a diffractive dielectric component according to a second embodiment with impedance matching.

In a second embodiment, illustrated in FIG. 8, the dielectric component 70 also comprises on a first face, the diffractive face, main microstructures, laid out in zones, as pillars 72, with variable sizes in order to obtain an index gradient as explained above.

On these pillars 72, are integrated protruding secondary sub-wavelength microstructures, which are micro-pillars 74 of a period with an order of magnitude of less than the period $\Lambda_s$ of the pillars 72. Further, micro-pillars 76 are also integrated onto the second face of the dielectric component 70, which is opposite to the first face, thereby allowing impedance matching to be achieved on both interfaces of the lens and therefore further reduction of the losses by reflection. When the second face does not include main sub-wavelength microstructures, the micro-pillars 76 have a period $\Lambda_1$ comprised in a wider range such that $\Lambda_s/10\leq\Lambda_1\leq\Lambda_s$.

Figure 9:
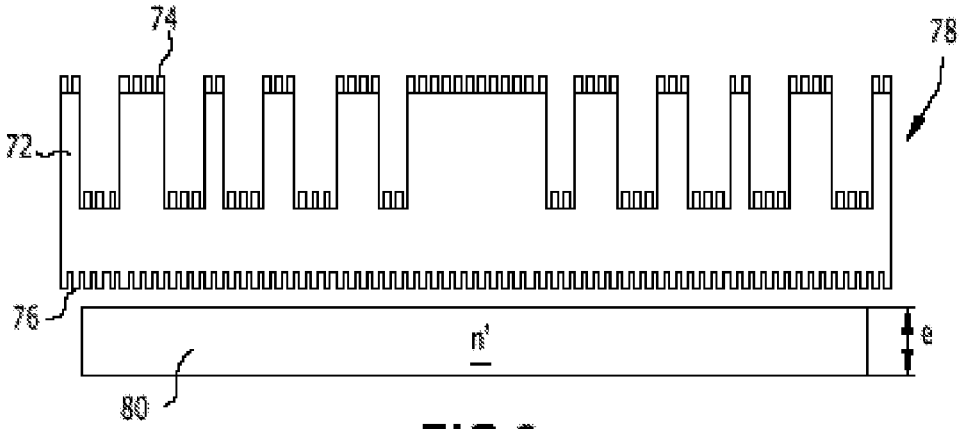
FIG. 9 is a sectional view of a diffractive dielectric component according to a third embodiment with impedance matching.

According to a third embodiment illustrated in FIG. 9, the dielectric component 78 is built by adding, as compared with the embodiment of FIG. 8, a neutral dielectric plate 80 with a thickness E equal to $\lambda_0/2n'$ wherein $\lambda_0$ is the target wavelength and n' is the refractive index of the plate. The dielectric plate has a transmission coefficient of 1 at wavelength $\lambda_0$, under normal incidence. Advantageously, the sub-wavelength microstructures of the dielectric component 78 are better protected relatively to the outside environment, this plate placed at the output of the dielectric component may be used as a protective plate against dust and rain for example.

The dielectric plate 80 may be positioned in the portion where the beam is slightly divergent, and therefore for a very open system (small F/D, F/D≤1 for example) behind the dielectric component 78, i.e. on the side of the dielectric component 78 which does not face the source. An example would be a plate of Rexolite with a thickness of 2.25 mm for guaranteeing a transmission of the plate of more than 99.5% between 40.5 GHz and 4.25 GHz.

Figure 10:
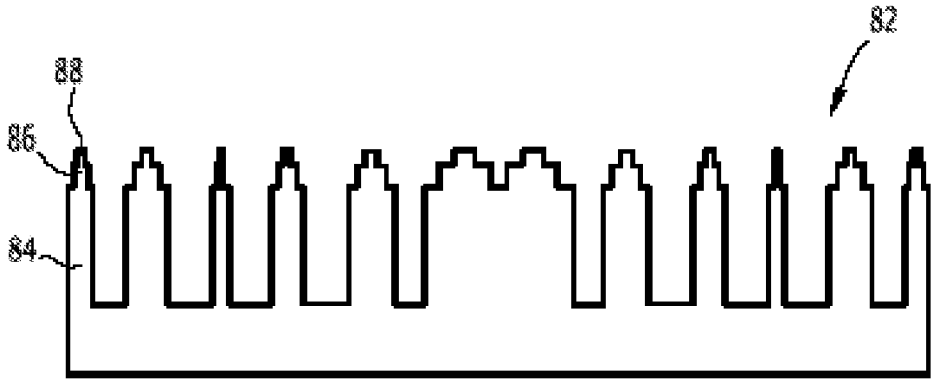
FIG. 10 is a sectional view of a diffractive dielectric component according to a fourth embodiment with impedance matching.

According to a fourth embodiment, illustrated in FIG. 10, the dielectric component 82 is formed with a stack of sub-wavelength pillar geometries in several layers. On a layer of main microstructures 84, which are pillars in this exemplary embodiment, are added two layers of secondary sub-wavelength microstructures, which are formed with micro-pillars 86 and 88 with increasingly thin sizes respectively. Thus, the width of the micro-pillars 86 is smaller than the width of the pillars 84, and the width of the micro-pillars 88 is smaller than the micro-pillars 86. With this embodiment, it is possible to improve impedance matching, i.e. reduction in reflection losses, while allowing gradual index matching between the air and the material. Further, such a component is easier to make than a component having a single anti-reflective layer formed by a plurality of very thin micro-pillars. The example of FIG. 10 includes two layers of secondary microstructures but a larger number of layers is achieved in an alternative method.

Figure 11:
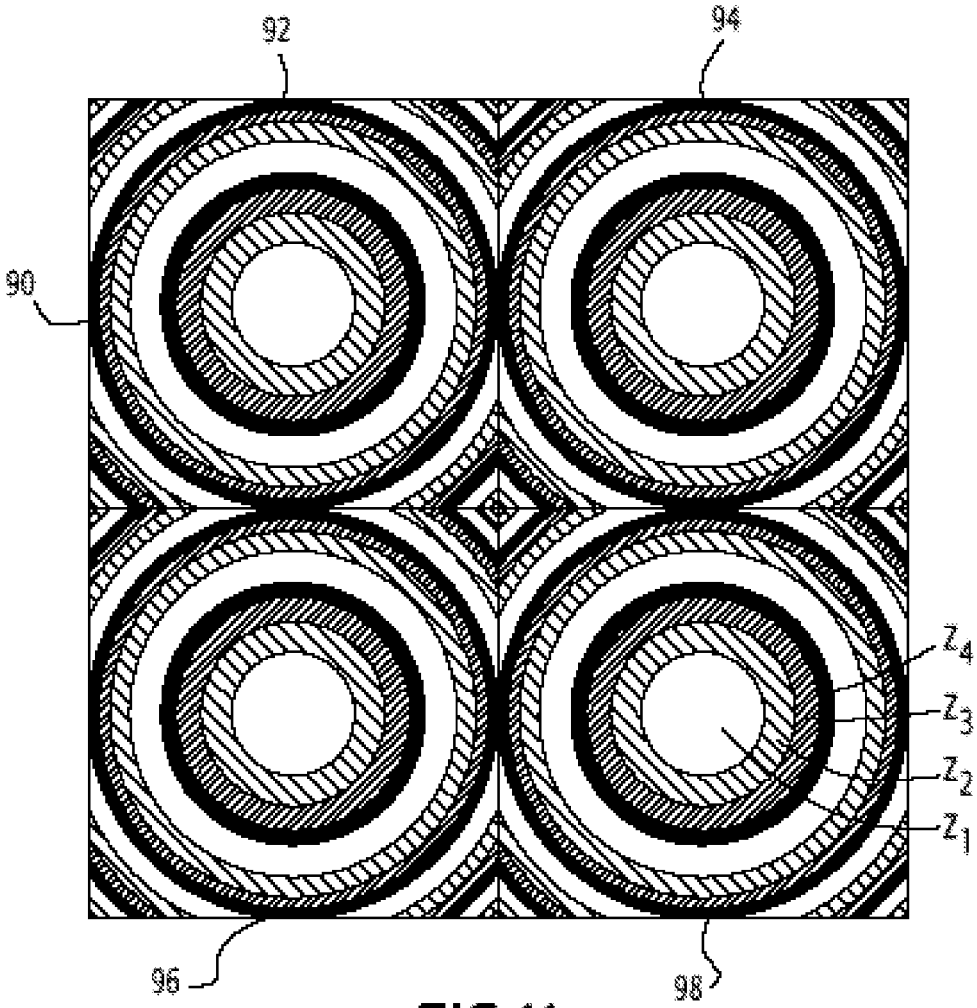
FIG. 11 is a top view of an array of diffractive dielectric components with sub-wavelength microstructures.

In another embodiment, a lens antenna according to the invention comprises a dielectric system consisting of a square or more generally rectangular array of diffractive dielectric components comprising sub-wavelength microstructures as described above. FIG. 11 describes such a dielectric system 90 formed with a square array 2×2 of four components 92, 94, 96, 98.

Each of the components is formed with concentric zones or rings z1, z2, z3 and z4, each zone consisting of sub-wavelength microstructures, for example pillars as described above. The proposed array has the advantage of not having any overlapping of one component over the other which makes it up, while ensuring the use of the whole of the useful zone (no dead zone in the array): the whole of the beam of waves arriving on the array is transformed by the array, there is no zone between the components of the array which does not contribute to collimation of the beam.

The layout as an p×q array allows more miniaturization of the dielectric system, since in order to obtain a given numerical aperture, the focal length and therefore the diameter of each lens of the array is divided by the size p of the array in one direction and by the size q of the array in the other direction.

Figure 12:
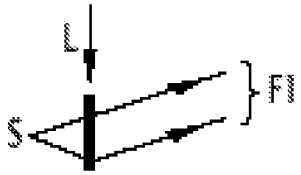
FIG. 12 is a diagram illustrating the deflection of waves by an off-axis lens.
Figure 13:
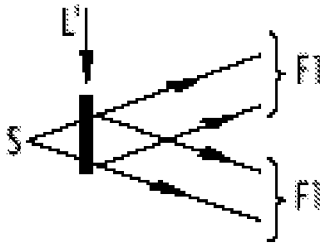
FIG. 13 is a diagram illustrating the generation of two beams of waves.
Figure 14:
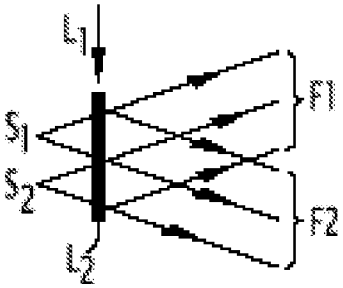
FIG. 14 is a diagram illustrating the generation of two beams of waves from multiple wave sources.

FIGS. 12 to 14 illustrate other useful functionalities for antennas in the microwave frequency domain which may be achieved with diffractive dielectric systems as described above. For example with these functionalities it is possible to direct the beam in an intended direction, or to cover multiple directions and/or they may be combined with an array of sources in order to reduce the thickness of the antenna, in order to obtain point to multi-point connections. The point to multi-point functionality is implemented in a node of a capillary grating for example.

FIG. 12 illustrates the deflection of microwave frequency electromagnetic waves by using a dielectric component which is an off-axis lens L formed with sub-wavelength microwave structures. The microwave frequency waves stem from the source S. The lens L deflects the rays of the source in order to obtain a single beam F1.

FIG. 13 illustrates a lens L' formed with sub-wavelength microstructures allowing generation of two beams F1, F2 from a single source S, with identical or different energy distributions.

FIG. 14 illustrates an embodiment with a plurality of sources in a same plane S1, S2 which generate beams of waves towards a dielectric system consisting of an array of dielectric components L1, L2 with which two wave beams F1, F2 may be obtained.

Thus, it will be understood that the term of "shaping a wavefront" includes the various kinds of "shaping a wavefront", described above with reference to FIGS. 12 to 14, such as the deflection of a beam of waves and the separation of a beam of waves into two or more beams of waves.

According to an alternative now shown in the figures, several diffractive dielectric components as described are associated, for example behind each other with air layers separating them in a lens antenna according to the invention.

It is also noted that the dielectric components with sub-wavelength microstructures are also able to obtain better focusing efficiency in a wide band (rated wavelength ±20%) than conventional components with a blazed profile.

Generally, one of the advantages of the dielectric components according to the invention is their manufacturing, which may easily be carried out for series of components and at a low cost, because of their dimensioning. It is possible to manufacture a mold which may be used for a production series, and therefore each diffractive dielectric component is made by molding/removal from the mold, in a single manufacturing step.

Depending on the frequency domain and on the size the antennas, there exist different types of technology for making a lens depending on the materials.

For example, the materials are selected from the following materials, for which permittivity $\in$ and the refractive index n are indicated: Rexolite 1422 ($\in$=2.53, n=1.59), Plexiglas $\in$=n=1.6, teflon (PTFE—$\in$=2.07 n=1.43), Pyrex 7740 ($\in$=4.6 n=2.14), Rogers RO3006 ($\in$=6.15 n=2.48), Rogers RO3010 ($\in$=10.2 n=3.19), alumina $Al_2O_3$ ($\in$=9.9 n=3.14), barium titanate SH110 ($\in$=110 n=10.5).

Various manufacturing techniques may be contemplated, such as for example:

- mechanical machining;
- molding;
- sintering (or low temperature co-sintering, LTCC): in a composite material based on a ceramic, the base shape is manufactured and then it is pressed and cooked at a high temperature (e.g. 900° C.), which allows removal of the polymer from the base form;
- techniques for stacking a ceramic or printed circuits;
- laser machining.

The common point of these manufacturing methods is the facility for manufacturing diffractive dielectric components with sub-wavelength microstructures for a lens antenna in a large number and at a low manufacturing cost.

The invention claimed is:

1. A lens antenna including at least one diffractive dielectric component possessing a focal point and configured to shape a microwave frequency wavefront emitted by a microwave frequency source having a wavelength comprised in a range from 1 mm to 50 centimeters, the microwave frequency source being located in proximity to the focal point of the diffractive dielectric component, wherein said diffractive dielectric component includes a plurality of main microstructures formed in a substrate material with a substrate refractive index ($n_s$) so as to form an artificial material with an effective refractive index (n), each main microstructure having a size (d) smaller than a target wavelength ($\lambda_0$) taken from said range of wavelengths, said main microstructures being laid out per zones, so as to make a surface filling level vary, the effective refractive index (n) being a function of said surface filling level, the layout being such that the effective refractive index (n) varies inside at least one of said zones of said diffractive dielectric component quasi monotonously between a minimum value and a maximum value less than or equal to the substrate refractive index ($n_s$).

2. The lens antenna according to claim 1, wherein the density of main microstructures per unit surface varies in the at least one of said zones of said dielectric component, the size ($d_1$) of each main microstructure being set.

3. The lens antenna according to claim 1, wherein the size (d) of said main microstructures is variable for the at least one of said zones of said dielectric components.

4. The lens antenna according to claim 1, wherein said main microstructures are with a square or circular section, with a width equal to K times the target wavelength ($\lambda_0$) taken from said range of wavelengths, K being comprised between 1/50 and 1/1.5.

5. The lens antenna according to claim 1, wherein said main microstructures are pillars formed as protrusions on said substrate material and/or holes formed in said substrate material.

6. The lens antenna according to claim 5, said main microstructures being pillars formed as protrusions on said substrate material, wherein said diffractive dielectric component further includes in addition to said main microstructures, at least one layer including secondary microstructures with a size of less than the size of said main microstructures, said secondary microstructures being matched so as to reduce the reflections of an incident microwave frequency wave.

7. The lens antenna according to claim 6, wherein said diffractive dielectric component includes several layers of stacked secondary microstructures, each layer of secondary microstructures comprising pillars formed as protrusions on said main or secondary microstructures of the layer preceding said layer of secondary microstructures.

8. The lens antenna according to claim 7, wherein said main microstructures are positioned on a first face of said diffractive dielectric component, and wherein said diffractive dielectric component includes a non-diffractive layer of sub-wavelength microstructures, producing an associated phase function on a second face of said diffractive dielectric component, opposite to said first face.

9. The lens antenna according to claim 6, wherein said main microstructures are positioned on a first face of said diffractive dielectric component, and wherein said diffractive dielectric component includes a layer of secondary microstructures positioned on a second face of said diffractive dielectric component opposite to said first face.

10. The lens antenna according to claim 5, wherein said main microstructures and/or said secondary microstructures have a conical shape.

11. The lens antenna according to claim 1, wherein said diffractive dielectric component further includes a protective neutral dielectric plate with a thickness depending on said target wavelength.

12. The lens antenna according to claim 1, wherein said diffractive dielectric component is a rectangular array of said diffractive dielectric components with a square or rectangular section.

13. The lens antenna according to claim 1, wherein the microwave frequency source is spaced away from the diffractive dielectric component.

* * * * *